United States Patent [19]

Svoboda

[11] Patent Number: 4,900,172

[45] Date of Patent: Feb. 13, 1990

[54] PRINTER ASSEMBLY WITH PAPER GUIDE

[76] Inventor: Rudolf Svoboda, Bretschneiderstrasse, A-3100 St. Pölten, Niederösterreich, Austria

[21] Appl. No.: 346,291

[22] Filed: Apr. 28, 1989

Related U.S. Application Data

[63] Continuation of Ser. No. 108,193, Oct. 13, 1987, abandoned.

[30] Foreign Application Priority Data

Oct. 13, 1986 [AT] Austria ..... 2721/86

[51] Int. Cl.[4] ..... B41J 15/04; B41J 15/18

[52] U.S. Cl. ..... 400/605; 400/613.2; 400/613.2; 400/690.1

[58] Field of Search ..... 400/611, 613, 613.1, 400/613.2, 613.3, 614, 615, 619, 605, 690.1, 642

[56] References Cited

U.S. PATENT DOCUMENTS

| | | | |
|---|---|---|---|
| 2,018,052 | 10/1935 | Caton | 400/613.2 |
| 2,126,644 | 8/1938 | Lake | 400/611 X |
| 2,348,059 | 5/1944 | Daly | 400/611 X |
| 2,915,969 | 12/1959 | Werner et al. | 101/93 |
| 3,753,483 | 8/1973 | Lundquist et al. | 400/649 |
| 4,164,376 | 8/1979 | Yarp | 400/642 |
| 4,215,762 | 8/1980 | Cunningham et al. | 400/690.1 X |
| 4,302,116 | 11/1981 | May et al. | 400/642 X |
| 4,448,559 | 5/1984 | Matsuda | 400/613.1 X |
| 4,492,160 | 1/1985 | Clark et al. | 101/375 X |
| 4,563,102 | 1/1986 | Sanders, Jr. et al. | 400/613.2 X |
| 4,607,969 | 8/1986 | Collina | 400/642 |
| 4,702,629 | 10/1987 | Hamano et al. | 400/642 X |
| 4,732;501 | 3/1988 | Angst et al. | 400/605 X |

FOREIGN PATENT DOCUMENTS

| | | | |
|---|---|---|---|
| 89287 | 9/1983 | European Pat. Off. | 400/642 |
| 0165130 | 12/1985 | European Pat. Off. | 400/613.2 |
| 0195572 | 9/1986 | European Pat. Off. | 400/605 |
| 905374 | 3/1954 | Fed. Rep. of Germany | 400/613 |
| 2830703 | 2/1979 | Fed. Rep. of Germany | 400/611 |
| 8606677 | 6/1986 | Fed. Rep. of Germany | . |
| 0157778 | 9/1982 | Japan | 400/611 |
| 114082 | 6/1984 | Japan | 400/642 |
| WO85/01697 | 4/1985 | PCT Int'l Appl. | 400/613.2 |
| 1299886 | 12/1972 | United Kingdom | . |

OTHER PUBLICATIONS

Garrison et al., "Paper Feed", *IBM Tech. Disc. Bull,* vol. 22, No. 5, pp. 1746–1748, 10/1979.

Manning et al., "Printing Forms Guide", *IBM Tech. Disc. Bull.*, vol. 20, No. 8, p. 3049; 01/1978.

*Primary Examiner*—Clifford D. Crowder

*Attorney, Agent, or Firm*—Herbert Dubno

[57] ABSTRACT

A printer assembly having a printer on a support or table and, in addition, a paper guide formed by a pair of bent plate members spaced apart from one another and defining a gap through which a paper web can travel from an inlet edge of the guide to an outlet edge thereof. While one edge of the guide is closely juxtaposed with an inlet or outlet opening of the printer, the opposite edge is freely accessible to the fingers of the operator to facilitate insertion of the paper web and is not obstructed by either the printer or the table.

17 Claims, 4 Drawing Sheets

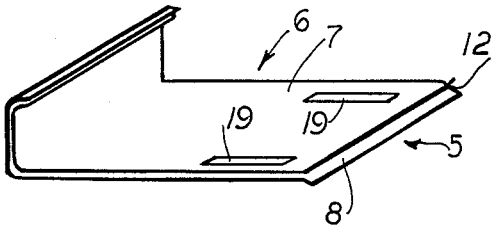
FIG.11
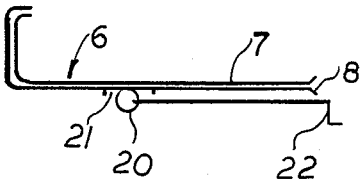
FIG.12
FIG.13
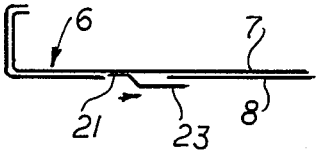
FIG.14
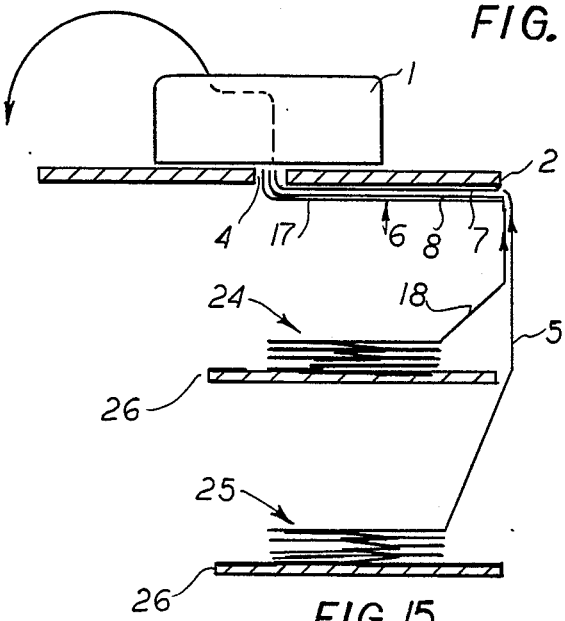
FIG.15
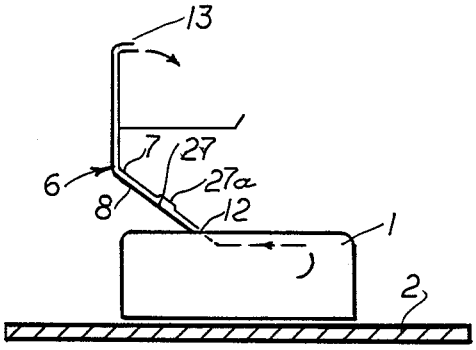

PRINTER ASSEMBLY WITH PAPER GUIDE

This is a continuation of co-pending application Ser. No. 07/108,193 filed on 13 Oct. 1987, now abandoned.

FIELD OF THE INVENTION

My present invention relates to a printer assembly including a support for a printer, e.g. a table or stand which can be provided with a supply of a paper web to be printed, a printer resting upon the support (e.g. driven by a computer or terminal), and a paper guide between the printer and either a collector for the printed paper web or the aforementioned supply of the paper web.

BACKGROUND OF THE INVENTION

It is known to provide a printer as a self-contained unit having an inlet opening for a paper web to be printed, an outlet opening from which the paper web is to be discharged and means within the printer defining a path for the paper web in the course of which the paper web interacts with a data-transfer device which prints alphanumeric or other characters upon the paper web.

Such printers are generally associated with computers and/or terminals for data processing, word processing and computation purposes and can constitute an output device for the computer.

The paper web which is fed to the printer is available as a folded stack which has its leaves connected together at junctions at which the leaves may be readily separated when the stack is subjected to a bursting or other severance process. In the case of a tractor-fed printer, along one or both of the edges of the web, strips may be provided with perforations which can engage in sprocket wheels. These strips may be removed along score-lines or perforated zones as well.

Friction-fed printers need not use a tractor arrangement with perforated strips but may clamp the paper web between a platen and pressure rollers.

The printers may be dot matrix, daisy wheel, ink jet, thimble or spool printers. They may make use of thermal transfer, inked ribbons or bands or even dry-transfer image-reproduction techniques. Indeed, this listing is by way of illustration only and is not intended to be comprehensive or in any way limiting of the instant invention.

To assure a compact facility, it is common practice to provide a stand or table for the printer which simultaneously serves to supply the fanfold paper forming the paper web to the latter, e.g. from a shelf on the stand below the table upon which the printer is supported.

In European patent publication EP-Al 165,130, an arrangement is described in which the supply of the paper web is located below the printer in the support table, passes through an opening in the side wall of the support table to feed to the printer from the rear and then the paper web is directed upwardly through another opening in the upper surface of the table turned through about 180° substantially parallel to another portion of the path of the web upstream from the latter opening to the printer.

Other systems for feeding a printer requiring relatively complex paths between a supply of the paper and the printer itself through, along and around a printer table are known as well. See for example PCT publication WO 85/01697 of 25 Apr. 1985.

In all of these cases, difficulties are encountered in threading the paper web through the table structure to the printer.

It may be mentioned that in all of these cases as well, there are various bends and turns in the path which can cause problems with respect to crimping, jamming and folding of the paper web if the latter is not fed with great precision along the path.

Since the paper must frequently be replaced or changed and often by untrained personnel and the process requires many manual operations and may involve different types of paths for different printers, the problem is pronounced an is of considerable concern in the workplace.

OBJECTS OF THE INVENTION

It is the principal object of the present invention to provide an improved printer assembly including the printer, the support or table and the guide, which will greatly simplify the feeding of paper to or from the printer.

Another object of this invention is to facilitate the feeding of a paper web to a printer so that rapid change or replacement of the paper is possible without requiring disassembly or contortions and in a manner which is not time-consuming or destructive of the paper web.

SUMMARY OF THE INVENTION

These objects and others which will become apparent hereinafter are attained, in accordance with the invention, with an assembly of a printer, a support or table and a paper guide which is provided in addition to the support and in openings which are formed therein and define a path for the paper web having at least one bend, the paper guide comprising a pair of mutually juxtaposed guide members having a width at least equal to the width of the paper web and spaced apart by a gap in which the paper web traverses over a length of the guide, between a paper inlet slit and a paper outlet slit. One of the slits is aligned with either the inlet opening or the outlet opening of the printer, depending upon whether the guide is to feed the paper web to the printer or discharge the paper web from the printer and the other slit is arranged so as to be freely accessible to the fingers of an operator so as to facilitate manual displacement of the paper web through the guide.

When I refer to the free accessibility of a slit of the paper guide to the fingers of an operator, I mean that this slit should be located so that the fingers of the operator can touch the edges of the slit directly and without operator contortions, i.e. this slit being directly accessible to the operator and not being covered or obstructed by the table or by any other structures which may overlap or overhang the slit so as to create any problems whatsoever in feeding the paper into the slit in the case in which the guide is to supply the machine.

The supply of paper can be located on a shelf below the table and a paper collector can be provided above the printer if desired.

The paper guide members can be plates which are mutually parallel and preferably coextensive having generally a J shape with a relatively long straight portion and a shorter leg.

One end of the guide and the corresponding slit may be juxtaposed closely with the corresponding opening of the printer while the other end of the guide and the slit thereof ends freely so that the slit can be directly reached by the fingers of the user. Optionally and preferably, windows are formed in at least one of the members constituting the guide, preferably in the form of elongated slots, through which a finger or a plurality of fingers can be inserted to enable manual advance of the paper web along the respective guide.

Preferably the freely accessible slit is also readily visible to the seated operator and can be easily reached by the operator from a seated position in which the operator normally accesses a keyboard or the like, thereby further reducing the need for contortions on the part of the operator to feed the printer.

According to a feature of the invention, means is provided for varying the length of the straight portion. This means can include a pair of telescopingly interfitting parts of the straight portion or extensions which can be shifted relative to stationary parts of the two members. The gap ahead of the guide path may be adjusted, according to the invention, by appropriate setting means, such as setscrews, cam levers or the like.

The guide may encompass more than one path so that a plurality of different paper webs may be selectively fed to the printer. In that case at least at one of the slits, for the paper web which is not needed, a clamping device, clip arrangement or like retainer can be provided.

Advantageously, one of the guide paths, preferably the lower guide path, is laterally open so that a new paper web can be inserted without interfering with the previously inserted paper web traversing the upper guide path. Between the members defining the guide paths, edge strips can be inserted adjustably to form lateral guides for the edges of the paper web.

BRIEF DESCRIPTION OF THE DRAWING

The above and other objects, features and advantages of the present invention will become more readily apparent from the following description, reference being made to the accompanying drawing in which:

FIG. 11 is a perspective view showing the members forming a guide path having windows through which the fingers of an operator can pass to advance the paper web;

FIGS. 12 and 13 are schematic sectional views illustrating mechanical feeders for the paper web;

FIG. 14 is a vertical section through an assembly according to the invention supplied with two paper webs from respective stacks and fanfold paper;

FIG. 15 is a side elevational view with the table in section of an assembly according to the invention where the paper guide serves to discharge the paper web from the printer;

SPECIFIC DESCRIPTION

Figure 1:
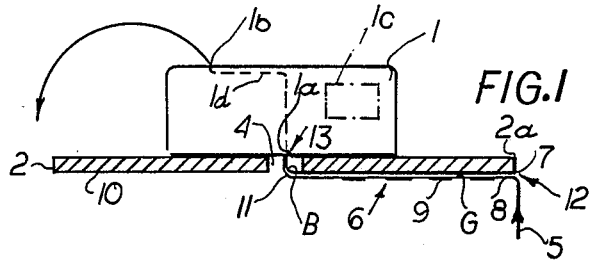
FIGS. 1–10 are diagrams representing side elevational views of a printer and sections through the support table showing various patterns of guide paths for paper webs in accordance with the invention.

FIGS. 1–10, 14 and 15 are highly diagrammatic views showing various paths of the paper web of the invention and since many elements are functionally similar in the various embodiments, corresponding reference numerals have been used for them. Naturally, the particular paper web path may vary depending upon the location of the inlet and outlet openings of the printer. In FIG. 1, for example, the printer inlet opening 1*a* is located at the bottom of the printer 1, the outlet opening is located at 1*b* at the top of the printer. Depending upon the printer type, of course, the path 1*d* of the paper web from the inlet to the outlet will vary, but in every case, means 1*c* will be provided to imprint alphanumeric or other characters upon the paper web.

The orientation, specific shape and location of the paper guide of the invention will, of course, vary depending upon the structure of the support and the particular printer type and whether this guide is to be used for feeding the paper web to or discharging the paper web from the printer.

Thus in FIG. 1 the printer 1 rests upon a support in the form of a printer table 2 having a slot-like opening 4 which registers with the inlet opening 1*d* of the printer.

The paper web 5, from a supply (not shown) which may be located below the table on a shelf of the latter, on a cart which can be rolled beneath the table, or another source, passes vertically into the paper guide 6 along which it moves first horizontally and then vertically to enter the printer.

The paper guide 6 is constituted of two sheet metal or sheet plastic guide members 7 and 8 which are spaced apart by a gap G and has an inlet slit 12 which is coterminous with an edge 2*a* of the table and a paper outlet slit 13 which opens directly into the inlet opening of the printer.

Each of the guide plates 7 and 8 is of angled configuration, i.e. has a bend B separating the long shank or portion 9 which is affixed to the underside 10 of the table and a short shank 11 which extends upwardly through the opening 4 in the table.

In this embodiment the guide 6 is laterally closed although it may be provided with slots or windows 19 through which the fingers of an operator can be inserted to assist in advancing the paper web and/or with the mechanical means shown in FIGS. 12 or 13 for this purpose.

In any event, the paper inlet edge 12 is not obstructed by the top of the table 2 or any other table part and is directly accessible to the fingers of the operator to facilitate insertion of the paper web into the inlet slit 12 without contortions by the operator.

Figure 2:
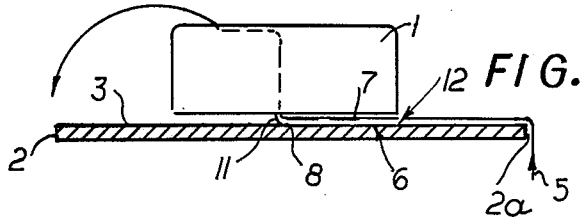

In the embodiment of FIG. 2, the guide 6 is structurally similar to that of FIG. 1, but rests on top of the table 2 on the upper surface 3 thereof. The long shank can end flush with the front of the printer so that the inlet slit 12 is readily accessible and freely available to the fingers of the user. The short shank 11 here extends upwardly into the inlet opening of the printer. Of course it is possible to extend the long shank to the edge 2*a* of the table in this embodiment as well.

In the embodiment of FIG. 3, again a similar guide 6 is used and the guide can extend to the table edge although to receive the guide, a recess is provided at 15 in the upper surface of the table 2. The recess 15 communicates with the opening 14 in the table through which the short shank of the guide 6 rises.

Figure 4:
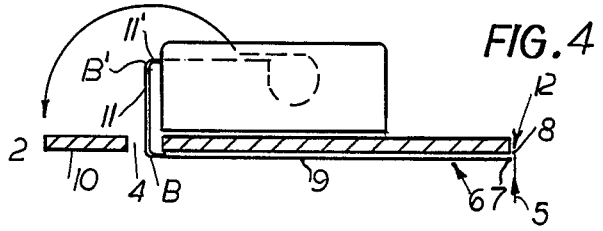

In the embodiment of FIG. 4, where the printer 1 has a rear inlet opening, the guide 6 is also of generally a J section and has in addition to the long shank 9 and the short shank 11 connected by the bend B, a further foot 11' connected to the short shank 11 by a further bend B'. This embodiment directs the paper web through 180° into the printer. The long shank extends to the edge of the table 2, is secured beneath the latter and has its inlet edge 12 accessible to the fingers of the operator.

Figure 5:
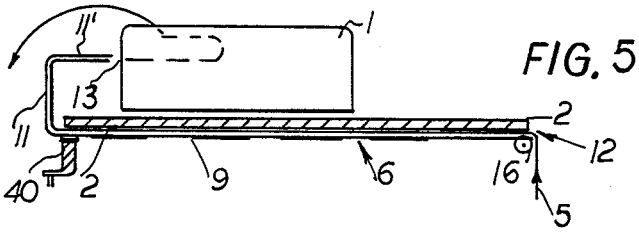

In FIG. 5, I have shown another embodiment of the guide for use with a table 2 having no opening 4 or 14 and a printer 1 with a rear inlet opening.

The shank 9 is here extended along the entire underside 10 of the table 2 while the leg 11 and its foot 11' reach around the rear edge thereof. The foot 11' is here somewhat longer. The inlet opening 12 at the opposite edge of the table 2 is readily accessible to the fingers of the user. To allow the outlet slit 13 to be positioned at various heights in accordance with the different heights in the inlet openings to rear-fed printers, the guide 6 is mounted on the table 2 by pivot means 16 so that it can swing as represented by the arrow C. The pivot 16 ca be provided with any clamp required for locking the guide in position. However, we prefer to provide the opposite end of the straight portion 9 with a screw spindle 40 which can be used to adjust the angular position of the guide about the pivot 16 for adjusting the requisite height of the paper-outlet slit 13.

Figure 6:
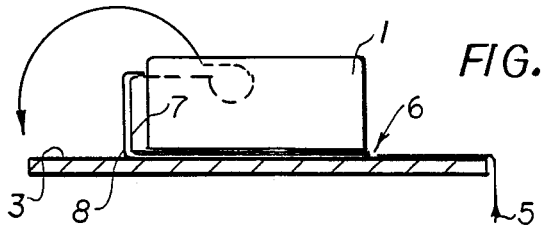

A guide 6 of the type shown in FIG. 4 can also be used in the rear-feed printer embodiment of FIG. 6 so that the long shank 9 rests on the upper surface 3 of the table 2 below the printer 1 so that the inlet slit is located at the front wall of the printer.

Figure 3:
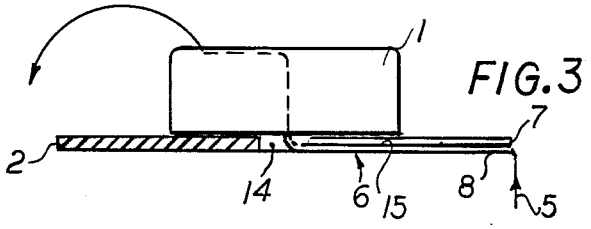
Figure 7:
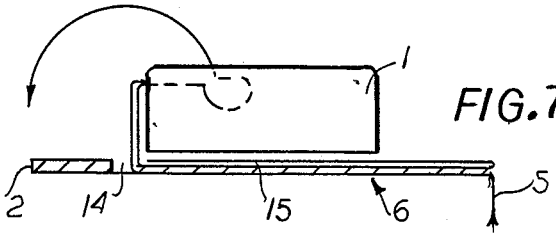

This guide also can be provided in a recess 15 in the table as illustrated in the embodiment of FIG. 7 which thus is analogous to the embodiment of FIG. 3.

Figure 8:
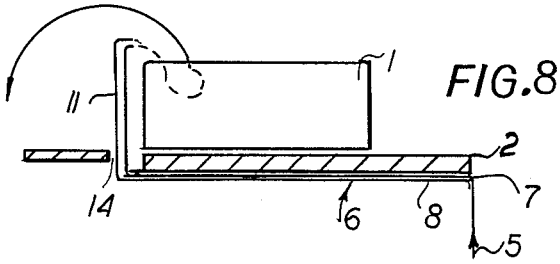

In FIG. 8 a similar guide with a modified leg 11 is used to feed the paper web into an inlet opening in the upper side of the printer.

Figure 9:
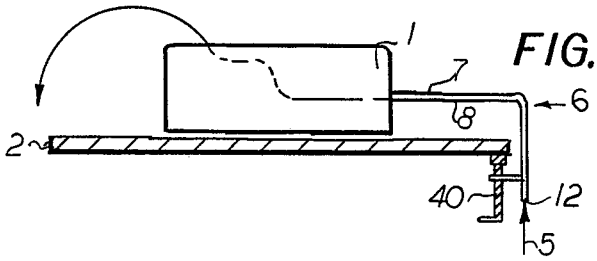

The angled guide in accordance with the invention can also be employed as shown at 6 in FIG. 9 to feed the paper web 5 into an inlet opening at the front of a printer 1. In this case, the inlet slit 12 is also freely accessible and unobstructed and the height may be adjusted by a spindle arrangement 40 similar to the one shown in FIG. 5.

Figure 10:
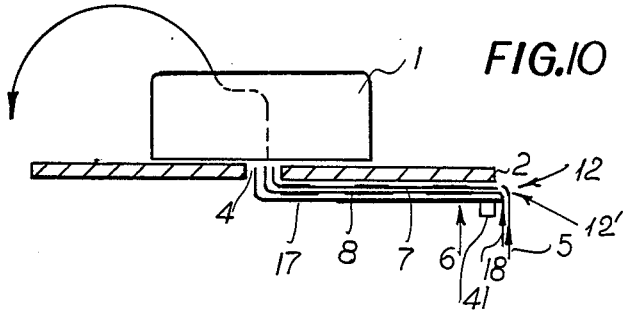

The guide of the invention can also be used to selectively feed either one of two paper webs to the printer 1 as has been illustrated in FIG. 10.

In this embodiment, the guide 6 has, parallel to the previously described members 7 and 8, a third guide member 17 defining a second gap with the lower guide member 8. In the two guide paths defined by these gaps, a paper web 5 and a paper web 18 may be fed.

At the end of the guide 6, a clamping means represented generally at 41 and not described in detail, e.g. in the form of clips or the like, can be provided to close the respective paths selectively while preventing the paper web of the closed path from pulling out of the guide.

This, of course, permits either paper web to be fed as desired to the printer. The inlet slits for both paths, of course, are readily accessible at 12 and 12' at the edge of the table 2.

In FIG. 11, we have shown the windows 19 referred to earlier which can be provided in the exposed members 7 or 8 of the guide, i.e. in the member 7 when the guide is provided on the top of the table or the member 8 when the guide is mounted on the bottom of the table. These openings 19 allow the fingers of the operator to be inserted to advance the paper web after it has been fed into the inlet slit 12.

In addition, e.g. further along the guide, a mechanical drive can be provided for moving the paper web through the guide, e.g. in the form of a drive roll 20 (FIG. 12) which extends through a corresponding opening in guide member 8 and can be rotated by a crank 22 or even an electric motor if desired.

In FIG. 13, I have shown a gripper 23 which can be moved back and forth in an opening 21 in member 8 to advance the paper web.

The drive elements 20 and 23, of course, have a free-running position in which they do not interfere with the movement of the paper web through the guide by the printer drive. Of course, in this state, the members 20 and 23 will also not obstruct the retraction of the web 5 from the guide for paper change or replacement.

FIG. 14 shows an embodiment in which two stacks of fanfold paper are provided on shelves 26 for the webs 5 and 18, respectively, and these stacks are represented generally at 24 and 25.

The web 5 is fed between the plate members 7 and 8 of the guide while the web 18 is fed between plate members 8 and 17 as described in connection with the embodiment of FIG. 10.

The guide path between the members 8 and 17 is laterally open so that, when the web 5 is in place, it is nevertheless possible to readily insert the web 18 laterally into its guide path. In this case, the means for securing the members defining the guide path together can be confined to one side of the guide paths, the other sides being laterally open. Of course, instead of having a guide path open to one side, member 17 may be mounted to be shiftable transversely to the transport direction of the web to permit replacement or renewal of the web 18.

As has been shown diagrammatically in FIG. 15, moreover, the guide 6 may be used at the outlet side of the printer 1 and here the members 7 and 8 have there inlet slit 12 close to the outlet opening of the printer although the outlet slit 13 is readily accessible. A viewing window 27 which can be covered by a transparent member 27*a* can be provided in member 7 to allow a viewing of the printed paper web.

Figure 16:
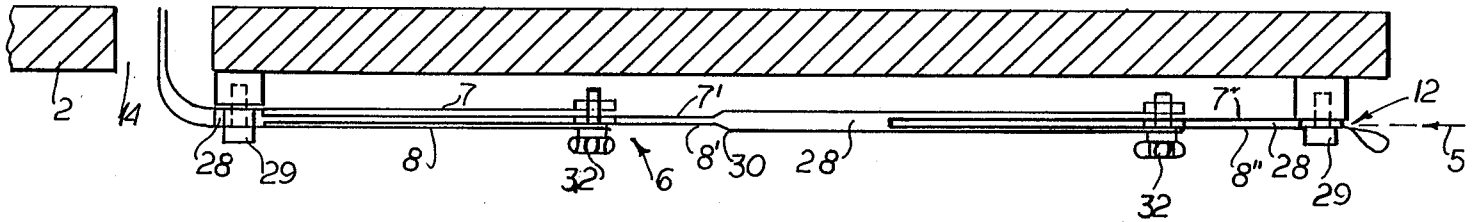
FIG. 16 is a detail view in diagrammatic section of the embodiment of FIG., 1.
Figure 17:
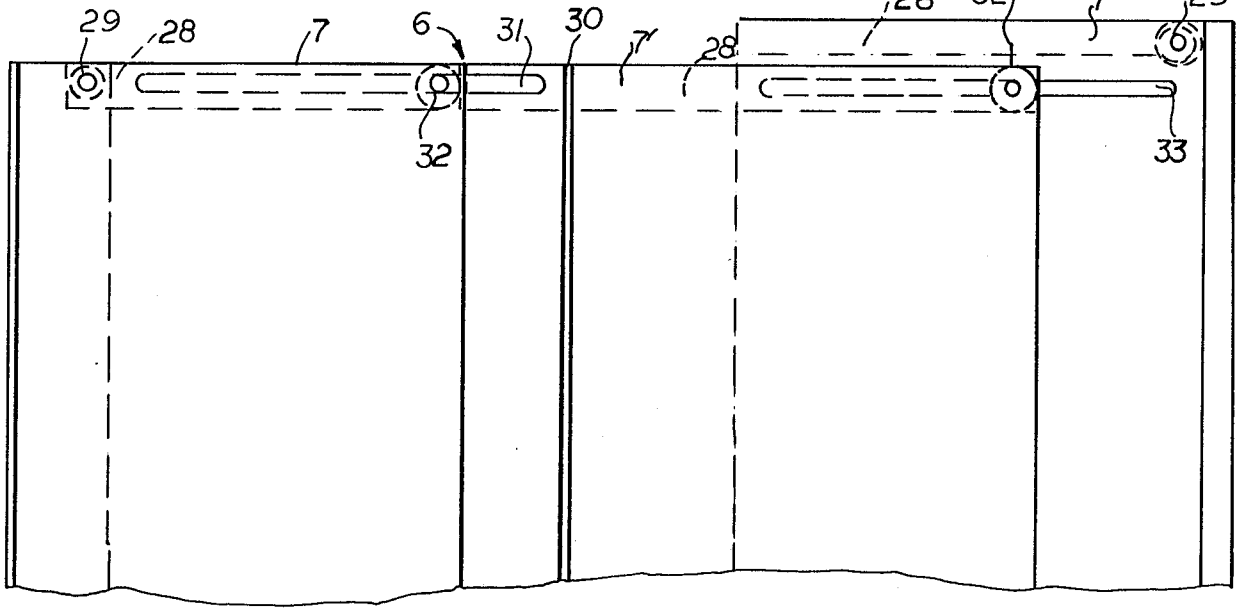
FIG. 17 is a partial plan view of the latter embodiment.

FIGS. 16 and 17 show the structure of the long shank or straight portion 9 of the guide in greater detail and the features thereof can be used, of course, in all of the other embodiments.

The plate members 7 and 8 of the guide are separated from one another along at least one lateral edge by edge strips 28 which provide a low-friction guiding of the paper web 5 of appropriate width.

The plate members 7 and 8 and the edge strips 28 are held together by threaded cap screws which extend holes in the members 8 and 28 and are threaded into counterthreads in the part 7.

Belleville-washer springs, spring disks or the like can be interposed between the members 7, 8 and 28 so as to be compressed by the screws to allow the height of the gap between members 7 and 8 to be adjusted to different possible thicknesses of the paper web 5.

Furthermore, the edge strips 28 can also be adjusted parallel to the direction of movement of the paper web 5. Advantageously, the holes traversed by the screws 29 in these strips 28 are transversely elongated so that these strips can be shifted laterally to adjust the position of the guides to various widths of the paper web.

It has been found to be advantageous to be able to vary the effective length at least of the straight section of the guide 6 and thereby position the inlet edge at a location at which it will be freely accessible to the fingers of the user. In this case we provide means for varying the effective length of the parts 7 and 8 by forming these parts with telescopingly interfitting parts 7', 7'' and 8', 8'' of which the parts 7'' and 8'' can be extended from the parts 7', 8'.

To this end, the parts 7′, 8′ are provided approximately midway therealong with offsets 30 and slots 31. The parts 7′ and 8′ also extend at the left-hand ends in FIGS. 16 and 17, between the members 7 and 8. Screws 32 traverse the slots 31 and corresponding slot in members 7 and 8.

The parts 7″ and 8″ also have slots 33 which are traversed by screws 32. Upon loosening the screws, the assembly 7, 8; 7″, 8″; can be pulled out to the right to any desired extent.

As can be seen at the right-hand side in FIG. 16, the inlet slit 12 widens in a funnel shape outwardly to facilitate insertion of the web. The edges defining the slits 12 in the other embodiments can be similarly flared outwardly.

The embodiments of the invention described can be modified in various ways within the spirit and scope of the appended claims without departing from them. For example, the members 7 and 8 can be transparent synthetic resin allowing viewing of the position and travel of the paper web. They can be composed of elastically yieldable material such as plastic to permit accommodation to different table contours. The adjustment of the gap width between members 7 and 8 can be effected by cam-lever arrangements in addition to the screw adjustments described.

I claim:

1. A printer assembly, comprising:

a printer having an inlet opening adapted to receive a paper web to be printed, an outlet opening for discharging the paper web following printing, and means between said openings forming a paper path therebetween along which the paper web is printed;

a horizontal support receiving said printer and provided with a supply of said paper web, said printer being spaced inwardly from an edge of said support;

a paper guide carried by said support and defining a path for said paper web having at least one bend, said paper guide comprising a pair of mutually juxtaposed guide members, each of said members having a width at least equal to the width of the paper web and being spaced apart by a gap in which the paper web travels over a length of said guide between a paper-inlet slit and a paper-outlet slit, said paper-inlet slit being located in a region of said edge and such that a major portion of the length of said paper guide is horizontal and extends between said edge and said printer, one of said slits being aligned with a corresponding one of said openings of said printer for selectively receiving the paper web from said printer and feeding the paper web to the printer, both of said mutually juxtaposed guide members having a pair of ends that form said other of said slits wherein both of said ends are located no further than a fingers length inwards of an end of said support so that the other of said slits being freely and directly accessible to fingers of a person for manual feed of the paper web to said guide, said guide members being of about equal length and each member being parallel to the other over substantially their full length;

means for varying the length of said straight portion, said means for varying the length of said straight portion including at least two mutually telescoping portions of said guide forming said straight portion; and means for adjusting the height of said gap between said members.

2. The printer assembly defined in claim 1 wherein said members are generally J-shaped and said guide has a relatively long straight portion and a relatively short leg adjoining said straight portion.

3. The printer assembly defined in claim 2 wherein said support is a table upon which said printer is positioned and said table is formed with an elongated recess, said straight portion being received in said recess.

4. The printer assembly defined in claim 1 wherein said means for adjusting the height of said gap between said members includes positioning screws for securing said members together.

5. The printer assembly defined in claim 1 wherein said paper guide is mounted on said support to deliver said paper web to said inlet opening of said printer.

6. The printer assembly defined in claim 5 wherein said paper guide is formed with at least one additional member defining a second gap extending parallel to the first-mentioned gap from a respective inlet slit to said printer to deliver to said printer a second paper web in addition to the first-mentioned paper web supplied to said printer by the first gap so that different paper webs can be supplied to said printer along the respective guide paths formed by said gaps.

7. The printer assembly defined in claim 6, further comprising means for blocking at least one of the slits of a respective one of said guide paths for supply of the printer with a paper web by the other of said guide paths.

8. The printer assembly defined in claim 6 wherein said guide paths are located one above another on said support, at least one of said guide paths being outwardly of said guide path laterally open to accept a respective paper web upon the lateral insertion of the paper web into said one of said guide paths.

9. The printer assembly defined in claim 8 wherein the lowermost one of said guide paths is laterally open.

10. The printer assembly defined in claim 5 wherein said support is a table upon which said printer is positioned and provided with an aperture, said guide members extending through said aperture.

11. The printer assembly defined in claim 5 wherein said support is a table upon which said printer is positioned and said guide with its paper-outlet slit juxtaposed with said inlet opening of said printer is mounted on said table so as to be adjustable in height thereon.

12. The printer assembly defined in claim 11 wherein said guide is swingably mounted at its end remote from said paper-outlet slit upon said table so as to pivot to adjust the height of said paper-outlet slit.

13. The printer assembly defined in claim 5, further comprising feed means along the length of said guide between said paper-inlet and paper-outlet slits for mechanically advancing said paper web through said guide.

14. The printer assembly defined in claim 13, further comprising means for decoupling said feed means from mechanical advance of said paper web through said guide to permit manual feed of the paper web therethrough.

15. The printer assembly defined in claim 1, further comprising edge strips positioned between said members for laterally guiding said paper web.

16. The printer assembly defined in claim 1 wherein said guide is positioned above said printer so that the paper-inlet slit is juxtaposed with said outlet opening for conducting the paper web away from said printer, at least one of said members being formed with a window along the length of said guide between said slits for viewing of the printed paper web.

17. The printer assembly defined in claim 1 wherein at least one of said members is provided with at least one window affording manual access to a paper web along said length of said guide.

* * * * *